US008540293B2

(12) United States Patent
Müller et al.

(10) Patent No.: US 8,540,293 B2
(45) Date of Patent: Sep. 24, 2013

(54) HANDLE CONFIGURATION

(75) Inventors: Dirk Müller, Essen (DE); Manfred Rohlfing, Velbert (DE); Stefan Mönig, Schwelm (DE); Rolf Kamps, Velbert (DE)

(73) Assignee: Huf Hulsbeck & Furst GmbH & Co. KG (DE)

( * ) Notice: Subject to any disclaimer, the term of this patent is extended or adjusted under 35 U.S.C. 154(b) by 449 days.

(21) Appl. No.: 12/301,289

(22) PCT Filed: May 11, 2007

(86) PCT No.: PCT/EP2007/054560

§ 371 (c)(1), (2), (4) Date: Jun. 29, 2009

(87) PCT Pub. No.: WO2007/134983

PCT Pub. Date: Nov. 29, 2007

(65) Prior Publication Data

US 2009/0302620 A1 Dec. 10, 2009

(30) Foreign Application Priority Data

May 18, 2006 (DE) ..... 10 2006 023 635

(51) Int. Cl.
*E05B 3/00* (2006.01)

(52) U.S. Cl.
USPC ..... 292/336.3; 292/DIG. 53; 292/DIG. 54; 292/DIG. 64

(58) Field of Classification Search
CPC ..... E05B 85/16; E05B 79/06; E04F 15/02; B25G 1/102
USPC ..... 292/336.3, DIG. 53, DIG. 54, DIG. 64; 16/110.1
See application file for complete search history.

(56) References Cited

U.S. PATENT DOCUMENTS 1,964,066 A * 6/1934 Kuszmaul ..... 70/149
4,343,501 A * 8/1982 Meeks ..... 292/336.3

(Continued)

FOREIGN PATENT DOCUMENTS

DE 3030519 2/1982
DE 32 31 210 * 2/1984

(Continued)

*Primary Examiner* — Kristina R Fulton
*Assistant Examiner* — Nathan Cumar
(74) *Attorney, Agent, or Firm* — Cantor Colburn LLP

(57) ABSTRACT

The invention relates to a handle configuration for a door, in particular for a motorized vehicle door, with an outside handle (1) mounted such that it can pivot, which is arranged on the outside on the type of exterior door fuselage (3) that has a concave external handle recess (2), where the outside handle (1) has a first (10) and a second bearing arm (20) arranged on the inside with the first bearing arm (10) mounted around a rotational axis (11), the outside handle (1) has face surfaces (5) in each of the areas of the first (10) and the second bearing arm (20) which face the exterior door fuselage (3) and with a gap (4) that exists between the face surface (5) and the exterior door fuselage (3). According to the invention, it is provided that the outside handle (1) is rotatably mounted in a guideway (12, 31), which is fundamentally matched to the contour of the concavity of the handle recess (2), by means of which a tolerance compensation can be achieved by moving the outside handle (1) along the guideway (12, 31), without a resulting contact of the outside handle (1) with the exterior door fuselage (3).

11 Claims, 1 Drawing Sheet

(56) References Cited

U.S. PATENT DOCUMENTS

| | | | | |
|---|---|---|---|---|
| 4,588,219 | A * | 5/1986 | Kobayashi et al. | 292/336.3 |
| 4,703,963 | A * | 11/1987 | Ball | 292/336.3 |
| 4,886,310 | A * | 12/1989 | Cyr et al. | 292/336.3 |
| 5,282,657 | A * | 2/1994 | Clinch et al. | 292/336.3 |
| 5,685,581 | A * | 11/1997 | Kritzler et al. | 292/336.3 |
| 7,104,575 | B2 * | 9/2006 | Kakita | 292/348 |
| 2002/0163205 | A1 * | 11/2002 | Sekulovic | 292/163 |
| 2004/0217601 | A1 * | 11/2004 | Garnault et al. | 292/336.3 |
| 2005/0012345 | A1 * | 1/2005 | Saitoh | 292/336.3 |

FOREIGN PATENT DOCUMENTS

| | | | |
|---|---|---|---|
| DE | 3231210 | | 2/1984 |
| DE | 3231210 | A1 * | 2/1984 |
| DE | 0 646 688 | * | 9/1994 |
| EP | 646688 | A1 * | 4/1995 |
| EP | 0646688 | A1 | 4/1995 |
| EP | 1473423 | | 11/2004 |

* cited by examiner

FIG.1
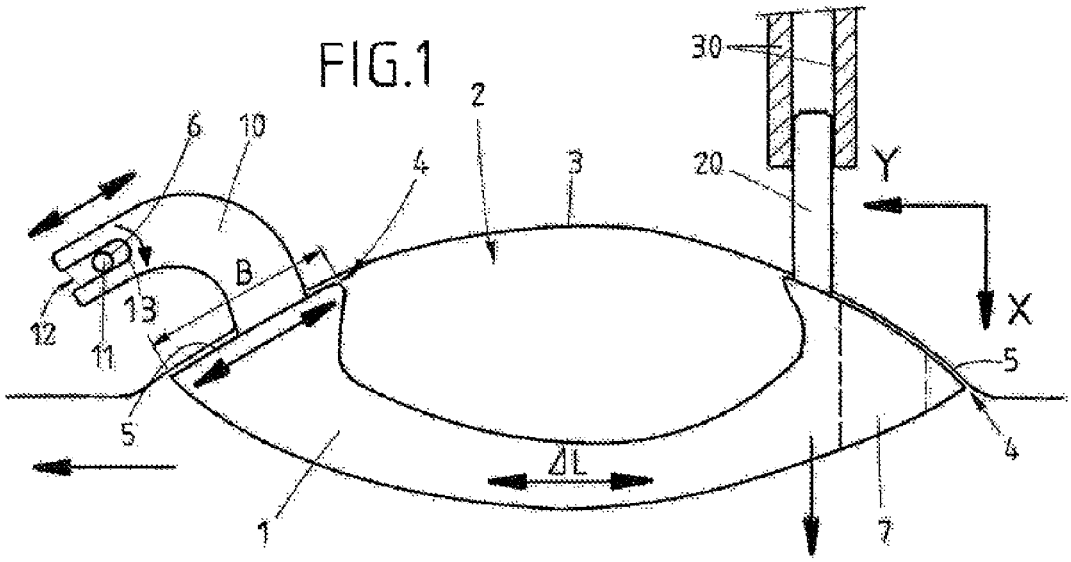
FIG.2
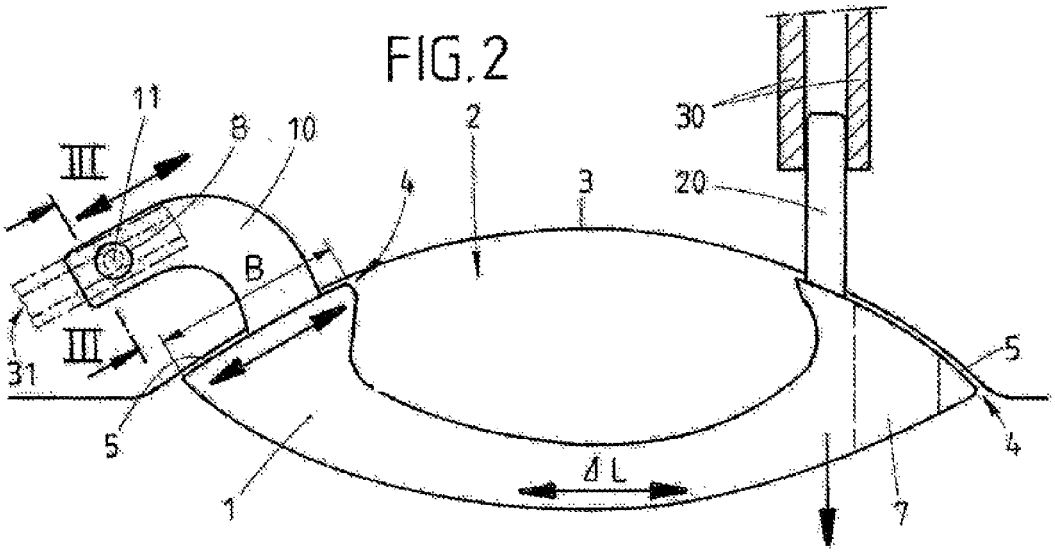
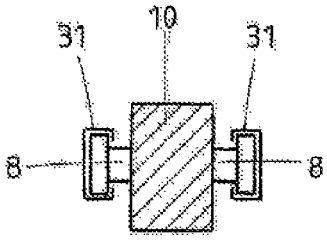
FIG.3

HANDLE CONFIGURATION

TECHNICAL FIELD OF INVENTION

The invention concerns a gripping device for a door, especially for a vehicle door, comprising a pivotally mounted external grip, which is provided on the exterior side on an outer door shell designed with a grip recess in an inwardly directed, curved fashion, whereby the external grip has an internal first and second bearing arm. The first bearing arm is located on an axis of rotation, the external grip has an abutting face in each area of the first and second bearing arm, the abutting face is turned toward the outer shell of the door, and there is a gap between the abutting face and the outer shell of the door.

BRIEF DESCRIPTION OF RELATED ART

Such gripping devices are basically known from practice. With the aid of such gripping devices especially side doors on vehicles can be opened and closed. The external grip can be designed as a pull grip for this purpose that opens an attached vehicle door lock by means of a release lever.

This works of course only when the closing cylinder of the gripping device is not in locked position. Alternatively the external grip will be blocked or a no-load stroke will be carried out with regard to the release lever. The associated vehicle door lock can also be activated by a signal instead of a release lever.

Problems of tolerance always occur with known gripping devices that are particularly negative during the assembly of the gripping device on the door and also in a built-in configuration of the gripping device. Temperature and moisture are two of many influences that can cause material expansion of the individual components in the gripping device. Beyond that, the individual elements of the gripping device have their own individual tolerances that also must be considered during assembly. If the exterior grip is already assembled on the door, it has been observed that due to material expansion the external grip can jam inside the grip recess, which negatively influences the function of the gripping device.

The invention makes available a gripping device that avoids the above-named disadvantages and can be assembled without considerable effort, whereby existing or future tolerances will not essentially disturb the function of the gripping device.

According to the invention, it is provided that the external grip is rotatably mounted in a guide that is essentially fitted to the contour of the curve of the grip recess, whereby tolerance compensation is achievable through motion of the external grip along the guide without the external grip coming into contact with the outer shell of the door.

As for tolerances occurring possibly inside the gripping device, tolerance compensation can be achieved by means of the guide according to the invention without there being a functional disturbance of the gripping device during assembly or when it is already built in. The external grip is always held at a distance from the outer shell of the door, whereby tolerance compensation can preferably be achieved by the motion of the external grip and the gap between the surface and the outer shell of the door remains essentially constant. In a preferred embodiment of the invention, there is a gap in the range of between 0.5 mm and 3 mm. It is especially advantageous that the external grip is simultaneously supported to be rotatable with its first bearing arm for tolerance compensation in the guide, whereby a compact gripping device can be achieved. Depending on the given tolerance compensation there is relative displacement of the axis of rotation along the guide. The first bearing arm is advantageously located around the axis of rotation on a floating bearing, whereby the second bearing arm is attached inside the vehicle door on a fixed bearing. The second bearing arm can simply be activated from the vehicle door by manually pulling on the external grip, whereby the second bearing arm is kept immovable in the direction of the vehicle inside the door construction. According to the invention the guide may not be a reproduction on the grip recess of the contour of the outer shell of the door. It is sufficient that the direction of the guide runs nearly parallel to the curved outer shell of the door. The angle between an imaginary tangent applied to a relevant area of the outer shell of the door that is turned toward the abutting face at the first bearing arm and the direction of the guide is preferably less than 20°, more preferable less than 10°, and especially preferred when less than 5°. The above-mentioned relevant area of the outer shell of the door may in this connection be bowed but also linear. A seal is advantageously provided in the area of the passage of the first bearing arm in the outer shell of the door particularly in order to avoid penetration of moisture into the vehicle door.

In a further advantageous embodiment of the invention the second bearing arm is guided on a counter bearing that is provided on a bearing construction on the door side so that for tolerance compensation only the abutting face of the first bearing arm is displaceable along the outer shell of the door. The gripping device is designed in this embodiment of the invention such that essentially only the abutting face of the external grip on the first bearing arm moves along the curved outer shell of the door for tolerance compensation. There is for the most part no movement on the abutting face of the second bearing arm, since the second bearing arm is firmly held in the direction of the vehicle. Besides, displacement of the abutting face of the external grip on the first bearing arm is not noticeable to the observer. That means, for example, that tolerance compensation by possible material expansion is compensated exclusively on the floating bearing through a movement of the door grip parallel or nearly parallel with the bow-formed metal of the grip recess. Since expansion of material evinces itself mainly as a change of length in the external grip, compensatory tolerance serves essentially as compensation of length in the present invention.

It can further be advantageous that the first bearing arm ends in a bearing fork that is provided with the guide, whereby the guide accepts a bearing journal connected with the support construction on the door side and the bearing journal forms the axis of rotation. According to the invention it can additionally be provided that the guide is put on the support construction on the door side, whereby the first bearing arm at least in part is accepted through the guide. It is reasonable in this embodiment to form the first bearing arm with at least one journal that is held in the guide. During tolerance compensation the first bearing arm moves along the guide of the door side, whereby at the same time the external grip moves along the curved grip recess. The guide can, for example, be designed as a kind of guide bar in which the journal of the first bearing arm is displaceable.

The first bearing arm can in a further alternative of the invention have two bearing journals that are provided on either side of the bearing arm and extend into the guide. The first bearing arm is advantageously integrally connected with the journal and the external grip. The bearing arm with journal and external grip can be produced as a die-cast part of plastic or metal. It is further possible to produce the external grip, the first and second bearing arm, and the journal, which establishes the connection between the first bearing arm and the guide, of differing material. Depending on operational demands, it may make sense to use a plastic material that is reinforced by means of glass fibers and/or carbon fibers and/or aramide fibers.

The guide is advantageously linear or curved. With linear geometry the guide almost fits the contour of the curve of the grip recess, i.e. with regard to tolerance compensation the guide runs almost parallel with the contour of the grip recess of the above-mentioned relevant area of the outer shell of the door. Optimal tolerance compensation is achieved by a curved guide that represents an actual copy of the contour of the grip recess. In a possible embodiment of the invention the guide and the contour of the curve of the grip recess are formed to curve, whereby the smallest distance between the guide and contour of the curve remains constant, i.e. there are no intersections between the two curves. This kind of gradient is also understood to be "parallel".

According to the invention the direction of the guide is at an angle $\alpha$ to the direction of the vehicle that is between $0° < \alpha \leq 50°$, preferably between $20° < \alpha \leq 45°$, and especially preferred between $25° < \alpha \leq 40°$. The range of the angle is determined by the gradient of the relevant area of the outer shell of the door that is turned to be spaced toward the abutting face of the first bearing arm.

BRIEF DESCRIPTION OF THE DRAWINGS

Further advantages, characteristics, and details of the invention can be seen from the following description in which examples of the invention are described in detail with reference to the drawings. The characteristics mentioned in the claims and in the description may be essential to the invention individually or in any random combination.

FIG. 1 shows a gripping device according to the invention with a first bearing arm that is in the shape of a fork.

FIG. 2 shows an alternative gripping device in which the first bearing arm is formed with a journal that extends into a guide on the door side and FIG. 3 shows a cross-sectional view of the line of intersection III-III according to FIG. 2.

DETAILED DESCRIPTION OF THE INVENTION

FIG. 1 shows a gripping device according to the invention that is mounted on a vehicle door. The gripping device has a pivotally mounted external grip 1 that has a first bearing arm 10 and a second bearing arm 20. External door handle 1 is attached on the external side to outer door shell 3 with a grip recess 2 curved toward the inside. First bearing arm 10 is mounted on an axis of rotation 11, whereby second bearing arm 20 is simply movable from out of the door in direction x.

Depicted external grip 1 is thus attached to the supporting construction on the door side by two bearings, whereby the area of first bearing arm 10 constitutes a floating bearing and the area of second bearing arm 20 a fixed bearing. External grip 1 has, in addition, an outer abutting face 5 turned toward outer door shell 3 each in the area of first bearing arm 10 and second bearing arm 20. There is a gap 4 between abutting face 5 and outer door shell 3 that in the present example amounts approx. to 2 mm.

First bearing arm 10 is formed with a bearing fork at its end that is provided with guide 12. A bearing journal 6 is accommodated in guide 12 that forms axis of rotation 11. Bearing journal 6 is provided on the door side of the supporting construction that is not exemplarily shown. Guide 12 is almost parallel with relevant area B of curved door shell 3. Tolerance compensation is effectuated by the floating bearing of first bearing arm 10 with any tolerance problems or expansion of material that essentially cause a change of length $\Delta L$ of the gripping device. In this case displacement of first bearing arm 10 occurs that is specified by the linear direction of guide 12.

Material expansion due, for example, to differences in temperature of external grip 1 are compensated in the gripping device according to the invention so that the left gripping area for the most part displaces outwardly along relevant area B of door shell 3, whereby gap 4 essentially remains constant. The movement of outer abutting face 5 of first bearing arm 10 is specified by guide 12 of first bearing arm 10. In case the material shrinks, abutting face 5 of first bearing arm 10 moves in the opposite direction, i.e. into the interior of curved grip recess 2, whereby the direction of movement is again specified by guide 12. Also in this case there is no contact of external grip 1 with outer door shell 3.

Possible movement of external grip 1 and of first bearing arm 10 is indicated by a double arrow in FIG. 1. During tolerance compensation that essentially corresponds to length compensation there is for the most part no movement of abutting face 5 of second bearing arm 20, since second bearing arm 20 is held immobile in the y direction and can be displaced from the vehicle door only in the x direction by manual pulling.

As can be seen in FIG. 1, external grip 1 has a retainer 7 on the side facing second bearing arm 20 for a cylinder lock that is not shown. When the user activates external grip 1, i.e. pulls external grip away from the door, external grip 1 turns around axis of rotation 11, whereby there is no displacement of first bearing arm 10 along guide 12, since second bearing arm 20 is fixed and mounted to be immovable in the y direction. In the present example the bearing fork of first bearing arm 10 is provided with a limit stop 13. Displacement of first bearing arm 10 for tolerance compensation can thus be maximally effected up to contact of bearing journal 6 with limit stop 13.

A further alternative of the gripping device according to the invention is shown in FIG. 2. Here the area of first bearing arm 10 represents the floating bearing and the area of second bearing arm 20 represents the fixed bearing of external grip 1, too. One of the essential differences is simply that first bearing arm 10 and guide 31 are formed differently for tolerance compensation. At the end of first bearing arm 10 two bearing journals 8 are provided that extend into guide 31, which is also shown in FIG. 3. In this embodiment of the invention first bearing arm 10 has on each side a bearing journal 8 that extends at its free end into guide 31 on the support construction on the door side and is guided by it during tolerance compensation. Like in the example according to FIG. 1, guide 31 is fitted to the contour of the curve of grip recess 2 of the relevant area B, i.e. essentially running parallel to curved outer door shell 3 of area B. Displacement of abutting face 5 of first bearing arm 10 parallel to outer door shell 3 also occurs in this example essentially for tolerance compensation, whereby the area of exterior grip 1 on second bearing arm 20 is reliably held in the y direction by counter bearing 30. In both examples an imaginary tangent applied to the relevant area B in the direction of guides 12 and 31 shows an angle that is less than 2°.

In case of a possible expansion of material, first bearing arm 10 moves with its bearing journal 8 along guide 31, whereby the left external grip area is displaced at the same time parallel along outer door shell 3. As can be seen in FIG. 3, the free ends of bearing journal 8 are torus shaped, i.e. are formed to be expanded in their cross section. Guide 31 incorporates bearing journal 8 at its ends, whereby a rail-like guide is achieved. It is, of course, possible in a further alternative to make the journals that extend into guide 31 cylindrical. In a further embodiment of the invention not shown, only one journal can be provided on first bearing arm 10 that extends into guide 31 on the door side.

The invention claimed is:

1. A gripping device for a door, especially for a vehicle door, comprising a pivotally mounted external grip, which is provided on an exterior side on an outer door shell designed with a grip recess in an inwardly directed, curved fashion, whereby an external grip has an internal first and second bearing arm, the first bearing arm is located on an axis of rotation, the external grip has an abutting face in each area of the first and second bearing arm, the abutting face is turned toward the outer door shell, and there is a gap between the abutting face and the outer door shell, wherein the external grip is rotatably mounted in a guide allowing for movement of at least one of the abutting faces of the external grip in a direction nearly parallel to the outer door shell, whereby tolerance compensation is achievable through linear motion of the first bearing arm of the external grip along the guide without the external grip coming into contact with the outer door shell, wherein said gap remains substantially constant during motion of the external grip, and wherein the guide is fitted to run nearly parallel to each of a contour of the grip recess of the outer door shell and the at least one of the abutting face of the external grip.

2. A gripping device according to claim 1, wherein said gap is in the range of between 0.5 mm≤s≤3 mm.

3. A gripping device according to claim 1, wherein the second bearing arm is guided on a counter bearing that is provided on a bearing construction on the door side so that for tolerance compensation only the abutting face of the first bearing arm is displaceable along the outer door shell.

4. A gripping device according to claim 1, wherein the first bearing arm ends in a bearing fork that is provided with a guide, whereby the guide accepts a bearing journal connected with a support construction on the door side, and the bearing journal forms the axis of rotation.

5. A gripping device according to claim 1, wherein the guide has at least on one side a limit stop.

6. A gripping device according to claim 1, wherein the guide is made linear or curved.

7. A gripping device according to claim 1, wherein the guide is provided on a support construction on the door side, whereby the first bearing arm at least in part is accepted through said guide.

8. A gripping device according to claim 7, wherein the first bearing arm has at least one journal which is retained in the guide.

9. A gripping device according to claim 1, wherein a direction of the guide is at an angle $\alpha$ to a direction of a vehicle that is between $0° < \alpha < 50°$.

10. A gripping device according to claim 1, wherein a free end of the journal is torus-shaped and thus formed to expand in its cross section.

11. A gripping device according to claim 1, wherein an angle between an imaginary tangent applied to a relevant area of the outer door shell that is turned toward the abutting face at the first bearing arm and a direction of the guide is less than 20°.

* * * * *